US011920344B2

(12) United States Patent
Pilz

(10) Patent No.: US 11,920,344 B2
(45) Date of Patent: Mar. 5, 2024

(54) TWO-PIECE DEFLECTION DRIFT ANGLE

(71) Applicant: CEMCO, LLC, City of Industry, CA (US)

(72) Inventor: Donald Anthony Pilz, Livermore, CA (US)

(73) Assignee: CEMCO, LLC, City of Industry, CA (US)

( * ) Notice: Subject to any disclaimer, the term of this patent is extended or adjusted under 35 U.S.C. 154(b) by 10 days.

(21) Appl. No.: 17/653,771

(22) Filed: Mar. 7, 2022

(65) Prior Publication Data

US 2022/0259852 A1 Aug. 18, 2022

Related U.S. Application Data

(63) Continuation of application No. 16/809,401, filed on Mar. 4, 2020, now Pat. No. 11,268,274.

(60) Provisional application No. 62/813,472, filed on Mar. 4, 2019.

(51) Int. Cl.
*E04B 1/94* (2006.01)
*E04B 2/74* (2006.01)

(52) U.S. Cl.
CPC ..... *E04B 1/948* (2013.01); *E04B 2/7411* (2013.01); *E04B 2/7457* (2013.01)

(58) Field of Classification Search
CPC ..... E04B 1/948; E04B 2/7411; E04B 2/7457
USPC ..... 52/396.01
See application file for complete search history.

(56) References Cited

U.S. PATENT DOCUMENTS 661,832 A 11/1900 Wilkinson
716,628 A 12/1902 Dickey
965,595 A 7/1910 Nicholson
1,130,722 A 3/1915 Fletcher
1,563,651 A 12/1925 Pomerantz
1,719,728 A 7/1929 Saunders
2,020,576 A 11/1935 Runde
2,105,771 A 1/1938 Holdsworth
2,114,386 A 4/1938 Killion
2,218,426 A 10/1940 Hulbert, Jr.
2,556,878 A 6/1951 Kohlhaas
2,664,739 A 1/1954 Marcy
2,683,927 A 7/1954 Maronek
2,733,786 A 2/1956 Drake
(Continued)

FOREIGN PATENT DOCUMENTS

CA 2234347 10/1999
CA 2498537 A1 8/2006
(Continued)

OTHER PUBLICATIONS

Patent Translate of Description EP 3348729 A1 from espacenet.com retriveable at https://translationportal.epo.org/emtp/translate?ACTION=description-retrieval&COUNTRY=EP&ENGINE=google&FORMAT=docdb&KIND=A1&LOCALE=en_EP&NUMBER=3348729&OPS=ops.epo.org%2F3.2&SRCLANG=de&apikey=TSMqTfrVAvNtryGl8QlfbozJ8DnAGlq.*
(Continued)

*Primary Examiner* — Brian D Mattei
*Assistant Examiner* — Joseph J. Sadlon
(74) *Attorney, Agent, or Firm* — Knobbe, Martens, Olson & Bear LLP

(57) ABSTRACT

A fire-rated component for a fire-rated joint, such as a head-of-wall assembly, includes a fire-rated assembly include a fire-rated angle and a gasket profile. The fire-rated angle can be coupled with the gasket profile to form a single unit within the head-of-wall assembly.

11 Claims, 5 Drawing Sheets

(56) References Cited

U.S. PATENT DOCUMENTS 2,994,114 A 8/1961 Black
3,019,866 A 2/1962 Grabowski
3,041,682 A 7/1962 Alderfer et al.
3,129,792 A 4/1964 Gwynne
3,153,467 A 10/1964 Nelsson et al.
3,271,920 A 9/1966 Downing, Jr.
3,309,826 A 3/1967 Zinn
3,324,615 A 6/1967 Zinn
3,346,909 A 10/1967 Blackburn
3,355,852 A 12/1967 Lally
3,397,495 A 8/1968 Thompson
3,460,302 A 8/1969 Cooper
3,481,090 A 12/1969 Joseph
3,493,460 A 2/1970 Windecker
3,495,417 A 2/1970 Ratliff
3,537,219 A 11/1970 Navarre
3,562,985 A 2/1971 Nicosia
3,566,559 A 3/1971 Dickson
3,600,854 A 8/1971 Dallaire et al.
3,604,167 A 9/1971 Hays
3,609,933 A 10/1971 Jahn et al.
3,648,419 A 3/1972 Marks
3,668,041 A 6/1972 Lonning
3,683,569 A 8/1972 Holm
3,696,569 A 10/1972 Didry
3,707,819 A 1/1973 Calhoun et al.
3,713,263 A 1/1973 Mullen
3,730,477 A 5/1973 Wavrunek
3,744,199 A 7/1973 Navarre
3,757,480 A 9/1973 Young
3,786,604 A 1/1974 Kramer
3,837,126 A 9/1974 Voiturier et al.
3,839,839 A 10/1974 Tillisch et al.
3,866,370 A 2/1975 Guarino et al.
3,908,328 A 9/1975 Nelsson
3,921,346 A 11/1975 Sauer et al.
3,922,830 A 12/1975 Guarino et al.
3,934,066 A 1/1976 Murch
3,935,681 A 2/1976 Voiturier et al.
3,955,330 A 5/1976 Wendt
3,964,214 A 6/1976 Wendt
3,974,607 A 8/1976 Balinski
3,976,825 A 8/1976 Anderberg
3,998,027 A 12/1976 Wendt et al.
4,011,704 A 3/1977 O'Konski
4,017,090 A 4/1977 Cohen
4,034,526 A * 7/1977 Deslaugiers ..... E04H 1/005 52/645
4,103,463 A 8/1978 Dixon
4,114,335 A * 9/1978 Carroll ..... E04D 13/1606 52/302.1
4,122,203 A 10/1978 Stahl
4,130,972 A 12/1978 Varlonga
4,139,664 A 2/1979 Wenrick
4,144,335 A 3/1979 Edwards
4,144,385 A 3/1979 Downing
4,152,878 A 5/1979 Balinski
4,164,107 A 8/1979 Kraemling et al.
4,178,728 A 12/1979 Ortmanns et al.
4,197,687 A 4/1980 Benoit
4,203,264 A 5/1980 Kiefer et al.
4,205,498 A 6/1980 Unayama
4,217,731 A 8/1980 Saino
4,269,890 A 5/1981 Breitling et al.
4,276,332 A 6/1981 Castle
4,281,494 A * 8/1981 Weinar ..... E04B 2/7411 52/509
4,283,892 A 8/1981 Brown
4,295,304 A 10/1981 Kim
4,318,253 A 3/1982 Wedel
4,324,835 A 4/1982 Keen
4,329,820 A 5/1982 Wendt
4,356,672 A 11/1982 Beckman et al.
4,361,994 A 12/1982 Carver
4,424,653 A 1/1984 Heinen
4,433,732 A 2/1984 Licht et al.
4,434,592 A 3/1984 Reneault et al.
4,437,274 A 3/1984 Slocum et al.
4,454,690 A 6/1984 Dixon
4,461,120 A 7/1984 Hemmerling
4,467,578 A 8/1984 Weinar
4,480,419 A 11/1984 Crites
4,495,238 A 1/1985 Adiletta
4,497,150 A 2/1985 Wendt et al.
4,507,901 A 4/1985 Carroll
4,509,559 A 4/1985 Cheetham et al.
4,517,782 A 5/1985 Shamszadeh
4,574,454 A 3/1986 Dyson
4,575,979 A 3/1986 Mariani
4,578,913 A 4/1986 Eich
4,598,516 A 7/1986 Groshong
4,622,791 A * 11/1986 Cook ..... E04B 2/825 52/288.1
4,622,794 A 11/1986 Geortner
4,632,865 A 12/1986 Tzur
4,649,089 A 3/1987 Thwaites
4,663,204 A 5/1987 Langham
4,672,785 A 6/1987 Salvo
4,709,517 A 12/1987 Mitchell et al.
4,711,183 A 12/1987 Handler et al.
4,723,385 A 2/1988 Kallstrom
4,756,945 A 7/1988 Gibb
4,761,927 A 8/1988 O'Keeffe et al.
4,787,767 A 11/1988 Wendt
4,788,802 A * 12/1988 Wokas ..... E04B 1/34869 52/34
4,798,035 A * 1/1989 Mitchell ..... E04B 2/7409 52/287.1
4,805,364 A 2/1989 Smolik
4,810,986 A 3/1989 Leupold
4,822,659 A 4/1989 Anderson et al.
4,825,610 A 5/1989 Gasteiger
4,830,913 A 5/1989 Ortmans et al.
4,845,904 A 7/1989 Menchetti
4,850,173 A 7/1989 Beyer et al.
4,850,385 A 7/1989 Harbeke
4,854,096 A 8/1989 Smolik
4,854,107 A 8/1989 Roberts
4,866,898 A 9/1989 LaRoche et al.
4,881,352 A 11/1989 Glockenstein
4,885,884 A 12/1989 Schilger
4,897,976 A 2/1990 Williams et al.
4,899,510 A 2/1990 Propst
4,914,880 A 4/1990 Albertini
4,918,761 A 4/1990 Harbeke
4,930,276 A 6/1990 Bawa et al.
4,935,281 A 6/1990 Tolbert et al.
4,982,540 A 1/1991 Thompson
4,986,040 A 1/1991 Prewer et al.
4,987,719 A 1/1991 Goodson, Jr.
4,992,310 A 2/1991 Gelb et al.
5,010,702 A 4/1991 Daw et al.
5,058,342 A 10/1991 Crompton
5,090,170 A 2/1992 Propst
5,094,780 A 3/1992 von Bonin
5,103,589 A 4/1992 Crawford
5,105,594 A 4/1992 Kirchner
5,111,579 A 5/1992 Andersen
5,125,203 A 6/1992 Daw
5,127,203 A 7/1992 Paquette
5,127,760 A 7/1992 Brady
5,140,792 A 8/1992 Daw et al.
5,146,723 A 9/1992 Greenwood et al.
5,152,113 A 10/1992 Guddas
5,155,957 A 10/1992 Robertson et al.
5,157,883 A 10/1992 Meyer
5,157,887 A 10/1992 Watterworth, III
5,167,876 A 12/1992 Lem
5,173,515 A 12/1992 von Bonin et al.
5,203,132 A 4/1993 Smolik
5,205,099 A 4/1993 Grünhage et al.
5,212,914 A 5/1993 Martin et al.
5,214,894 A 6/1993 Glesser-Lott
5,222,335 A 6/1993 Petrecca

(56) References Cited

U.S. PATENT DOCUMENTS 5,228,254 A 7/1993 Honeycutt, Jr.
5,244,709 A 9/1993 Vanderstukken
5,279,087 A 1/1994 Mann
5,279,088 A 1/1994 Heydon
5,279,091 A 1/1994 Williams et al.
5,285,615 A 2/1994 Gilmour
5,307,600 A * 5/1994 Simon, Jr. ..... B01L 1/04 52/293.3
5,315,804 A 5/1994 Attalla
5,319,339 A 6/1994 Leupold
5,325,651 A 7/1994 Meyer et al.
5,339,577 A 8/1994 Snyder
5,347,780 A 9/1994 Richards et al.
5,367,850 A 11/1994 Nicholas
5,374,036 A 12/1994 Rogers et al.
5,376,429 A 12/1994 McGroarty
5,390,458 A 2/1995 Menchetti
5,390,465 A 2/1995 Rajecki
5,394,665 A 3/1995 Johnson
5,412,919 A 5/1995 Pellock et al.
5,433,991 A 7/1995 Boyd, Jr. et al.
5,452,551 A 9/1995 Charland et al.
5,454,203 A 10/1995 Turner
5,456,050 A 10/1995 Ward
5,460,864 A 10/1995 Heitkamp
5,471,791 A 12/1995 Keller
5,471,805 A 12/1995 Becker
5,475,961 A 12/1995 Menchetti
5,477,652 A 12/1995 Torrey et al.
5,481,834 A * 1/1996 Kowalczyk ..... E04B 2/827 52/794.1
5,502,937 A 4/1996 Wilson
5,505,031 A 4/1996 Heydon
5,531,051 A 7/1996 Chenier, Jr. et al.
5,552,185 A 9/1996 De Keyser
5,592,796 A 1/1997 Landers
5,604,024 A 2/1997 von Bonin
5,607,758 A 3/1997 Schwartz
5,644,877 A 7/1997 Wood
5,687,538 A 11/1997 Frobosilo et al.
5,689,922 A 11/1997 Daudet
5,694,726 A * 12/1997 Wu ..... H02G 3/0431 52/287.1
5,709,821 A 1/1998 von Bonin et al.
5,724,784 A 3/1998 Menchetti
5,735,100 A 4/1998 Campbell
5,740,635 A 4/1998 Gil et al.
5,740,643 A 4/1998 Huntley
5,755,066 A 5/1998 Becker
5,765,332 A 6/1998 Landin et al.
5,782,690 A * 7/1998 Gustafson ..... A62C 2/18 160/1
5,787,651 A 8/1998 Horn et al.
5,797,233 A 8/1998 Hascall
5,798,679 A 8/1998 Pissanetzky
5,806,261 A 9/1998 Huebner et al.
5,820,958 A 10/1998 Swallow
5,822,935 A 10/1998 Mitchell et al.
5,870,866 A 2/1999 Herndon
5,913,788 A 6/1999 Herren
5,921,041 A 7/1999 Egri, II
5,927,041 A 7/1999 Sedlmeier et al.
5,930,963 A 8/1999 Nichols
5,930,968 A 8/1999 Pullman
5,945,182 A 8/1999 Fowler et al.
5,950,385 A 9/1999 Herren
5,968,615 A 10/1999 Schlappa
5,968,669 A 10/1999 Liu et al.
5,970,672 A 10/1999 Robinson
5,974,750 A 11/1999 Landin et al.
5,974,753 A 11/1999 Hsu
6,023,898 A 2/2000 Josey
6,058,668 A 5/2000 Herren
6,061,985 A 5/2000 Kraus et al.
6,110,559 A 8/2000 De Keyser
6,116,404 A 9/2000 Heuft et al.
6,119,411 A 9/2000 Mateu Gil et al.
6,125,608 A * 10/2000 Charlson ..... F16B 33/02 52/847
6,128,874 A 10/2000 Olson et al.
6,128,877 A 10/2000 Goodman et al.
6,131,352 A 10/2000 Barnes et al.
6,151,858 A 11/2000 Ruiz et al.
6,153,668 A 11/2000 Gestner et al.
6,176,053 B1 1/2001 St. Germain
6,182,407 B1 2/2001 Turpin et al.
6,189,277 B1 2/2001 Boscamp
6,207,077 B1 3/2001 Burnell-Jones
6,207,085 B1 3/2001 Ackerman
6,213,679 B1 4/2001 Frobosilo et al.
6,216,404 B1 4/2001 Vellrath
6,233,888 B1 5/2001 Wu
6,256,948 B1 7/2001 Van Dreumel
6,256,960 B1 7/2001 Babcock et al.
6,279,289 B1 8/2001 Soder et al.
6,305,133 B1 10/2001 Cornwall
6,318,044 B1 11/2001 Campbell
6,374,558 B1 4/2002 Surowiecki
6,381,913 B2 5/2002 Herren
6,393,774 B1 * 5/2002 Fisher ..... E04H 3/02 52/79.1
6,405,502 B1 6/2002 Cornwall
6,408,578 B1 6/2002 Tanaka et al.
6,430,881 B1 8/2002 Daudet et al.
6,470,638 B1 10/2002 Larson
6,487,825 B1 12/2002 Silik
6,574,930 B2 6/2003 Kiser
6,595,383 B2 7/2003 Pietrantoni
6,606,831 B2 8/2003 Degelsegger
6,647,691 B2 11/2003 Becker et al.
6,668,499 B2 12/2003 Degelsegger
6,679,015 B1 1/2004 Cornwall
6,688,056 B2 * 2/2004 Von Hoyningen Huene ..... E04B 2/745 52/243.1
6,698,146 B2 3/2004 Morgan et al.
6,705,047 B2 3/2004 Yulkowski
6,708,627 B1 3/2004 Wood
6,711,871 B2 3/2004 Beirise et al.
6,732,481 B2 5/2004 Stahl, Sr.
6,739,926 B2 5/2004 Riach et al.
6,748,705 B2 6/2004 Orszulak
6,783,345 B2 8/2004 Morgan et al.
6,792,733 B2 9/2004 Wheeler et al.
6,799,404 B2 10/2004 Spransy
6,843,035 B1 1/2005 Glynn
6,854,237 B2 2/2005 Surowiecki
6,871,470 B1 3/2005 Stover
6,944,997 B2 9/2005 Verkamp
6,951,162 B1 10/2005 Shockey et al.
6,996,944 B2 2/2006 Shaw
7,043,880 B2 5/2006 Morgan et al.
7,059,092 B2 6/2006 Harkins et al.
7,104,024 B1 9/2006 deGirolamo et al.
7,152,385 B2 12/2006 Morgan et al.
7,191,845 B2 3/2007 Loar
7,240,905 B1 7/2007 Stahl
7,251,918 B2 8/2007 Reif et al.
7,284,355 B2 * 10/2007 Becker ..... E04B 2/825 52/712
7,302,776 B2 12/2007 Duncan et al.
7,398,856 B2 7/2008 Foster et al.
7,413,024 B1 8/2008 Simontacchi et al.
7,441,565 B2 10/2008 Imamura et al.
7,487,591 B2 2/2009 Harkins et al.
7,497,056 B2 3/2009 Surowiecki
7,506,478 B2 3/2009 Bobenhausen
7,513,082 B2 4/2009 Johnson
7,540,118 B2 6/2009 Jensen
7,594,331 B2 9/2009 Andrews et al.
7,603,823 B2 10/2009 Cann
7,610,725 B2 11/2009 Willert
7,617,643 B2 11/2009 Pilz et al.
7,681,365 B2 3/2010 Klein

(56) References Cited

U.S. PATENT DOCUMENTS 7,685,792 B2 3/2010 Stahl, Sr. et al.
7,716,891 B2 5/2010 Radford
7,735,295 B2 6/2010 Surowiecki
7,752,817 B2 7/2010 Pilz et al.
7,770,348 B2 * 8/2010 Tollenaar ..... E04B 2/767 52/696
7,775,006 B2 8/2010 Giannos
7,776,170 B2 8/2010 Yu et al.
7,797,893 B2 9/2010 Stahl, Sr. et al.
7,810,295 B2 10/2010 Thompson
7,814,718 B2 10/2010 Klein
7,827,738 B2 11/2010 Abrams et al.
7,836,652 B2 11/2010 Futterman
7,866,108 B2 1/2011 Klein
7,870,698 B2 1/2011 Tonyan et al.
7,921,537 B2 4/2011 Rodlin
7,921,614 B2 4/2011 Fortin et al.
7,941,981 B2 5/2011 Shaw
7,950,198 B2 5/2011 Pilz et al.
7,966,778 B2 6/2011 Klein
7,984,592 B1 7/2011 Jiras
8,029,345 B2 10/2011 Messmer et al.
8,056,293 B2 11/2011 Klein
8,061,099 B2 11/2011 Andrews
8,062,108 B2 11/2011 Carlson et al.
8,069,625 B2 12/2011 Harkins et al.
8,074,412 B1 12/2011 Gogan et al.
8,074,416 B2 12/2011 Andrews
8,079,188 B2 12/2011 Swartz et al.
8,087,205 B2 1/2012 Pilz et al.
8,096,084 B2 1/2012 Studebaker et al.
8,100,164 B2 1/2012 Goodman et al.
8,132,376 B2 3/2012 Pilz et al.
8,136,314 B2 3/2012 Klein
8,151,526 B2 4/2012 Klein
8,181,404 B2 5/2012 Klein
8,225,581 B2 7/2012 Strickland et al.
8,281,552 B2 10/2012 Pilz et al.
8,286,397 B2 10/2012 Shaw
8,318,304 B2 11/2012 Valenziano
8,322,094 B2 12/2012 Pilz et al.
8,353,139 B2 1/2013 Pilz
8,375,666 B2 2/2013 Stahl, Jr. et al.
8,389,107 B2 3/2013 Riebel et al.
8,413,394 B2 4/2013 Pilz et al.
8,468,759 B2 6/2013 Klein
8,495,844 B1 * 7/2013 Johnson, Sr. ..... E04F 19/0463 52/287.1
8,499,512 B2 8/2013 Pilz et al.
8,539,732 B2 * 9/2013 Leahy ..... E04H 1/005 52/745.1
8,541,084 B2 9/2013 Deiss et al.
8,544,226 B2 10/2013 Rubel
8,555,566 B2 10/2013 Pilz et al.
8,578,672 B2 11/2013 Mattox et al.
8,584,415 B2 11/2013 Stahl, Jr. et al.
8,590,231 B2 11/2013 Pilz
8,595,999 B1 12/2013 Pilz et al.
8,596,019 B2 12/2013 Aitken
8,601,760 B2 12/2013 Hilburn, Jr.
8,607,519 B2 12/2013 Hilburn
8,640,415 B2 2/2014 Pilz et al.
8,646,235 B2 2/2014 Hilburn, Jr.
8,671,632 B2 3/2014 Pilz et al.
8,728,608 B2 5/2014 Maisch
8,782,977 B2 7/2014 Burgess
8,793,947 B2 8/2014 Pilz et al.
8,938,922 B2 1/2015 Pilz et al.
8,950,132 B2 2/2015 Collins et al.
8,955,275 B2 2/2015 Stahl, Jr.
8,973,319 B2 3/2015 Pilz et al.
9,045,899 B2 6/2015 Pilz et al.
9,085,907 B2 7/2015 Rutherford
9,127,454 B2 9/2015 Pilz et al.
9,151,042 B2 10/2015 Simon et al.
9,163,444 B1 10/2015 Fontijn et al.
9,206,596 B1 12/2015 Robinson
9,284,730 B2 3/2016 Klein
9,290,932 B2 3/2016 Pilz et al.
9,290,934 B2 3/2016 Pilz et al.
9,316,133 B2 4/2016 Schnitta
9,371,644 B2 6/2016 Pilz et al.
9,382,709 B2 * 7/2016 Collins ..... E04B 2/82
9,458,628 B2 10/2016 Pilz et al.
9,481,998 B2 11/2016 Pilz et al.
9,506,246 B2 11/2016 Joseph et al.
9,512,614 B2 12/2016 Klein et al.
9,523,193 B2 12/2016 Pilz
9,551,148 B2 1/2017 Pilz
9,616,259 B2 4/2017 Pilz et al.
9,637,914 B2 5/2017 Pilz et al.
9,683,364 B2 6/2017 Pilz et al.
9,719,253 B2 8/2017 Stahl, Jr. et al.
9,739,052 B2 8/2017 Pilz et al.
9,739,054 B2 8/2017 Pilz et al.
9,752,318 B2 9/2017 Pilz
9,879,421 B2 1/2018 Pilz
9,883,607 B2 * 1/2018 Bernard ..... H05K 7/1497
9,885,178 B1 2/2018 Barnes et al.
9,909,298 B2 3/2018 Pilz
9,931,527 B2 4/2018 Pilz et al.
9,995,039 B2 6/2018 Pilz et al.
10,000,923 B2 6/2018 Pilz
10,010,805 B2 * 7/2018 Maxam ..... A63J 1/02
10,011,983 B2 7/2018 Pilz et al.
10,077,550 B2 9/2018 Pilz
10,166,418 B2 1/2019 Förg et al.
10,174,499 B1 1/2019 Tinianov et al.
10,184,246 B2 1/2019 Pilz et al.
10,203,035 B1 * 2/2019 Robinson ..... F16J 15/108
10,214,901 B2 2/2019 Pilz et al.
10,227,775 B2 3/2019 Pilz et al.
10,246,871 B2 4/2019 Pilz
10,323,409 B1 * 6/2019 Robinson ..... E01C 11/106
10,323,411 B2 6/2019 Ackerman et al.
10,406,389 B2 9/2019 Pilz et al.
10,472,819 B2 11/2019 Klein et al.
10,480,654 B2 * 11/2019 Robinson ..... B32B 7/12
10,494,818 B2 12/2019 Maziarz
10,563,399 B2 2/2020 Pilz et al.
10,619,347 B2 4/2020 Pilz et al.
10,626,598 B2 4/2020 Klein
10,669,710 B2 6/2020 Förg
10,689,842 B2 6/2020 Pilz
10,731,338 B1 8/2020 Zemler et al.
10,753,084 B2 8/2020 Pilz et al.
10,900,223 B2 1/2021 Pilz
10,914,065 B2 2/2021 Pilz
10,920,416 B2 2/2021 Klein et al.
10,954,670 B2 3/2021 Pilz
11,041,306 B2 6/2021 Pilz et al.
11,060,283 B2 7/2021 Pilz et al.
11,111,666 B2 9/2021 Pilz
11,118,346 B2 9/2021 Klein et al.
11,141,613 B2 10/2021 Pilz et al.
11,149,432 B2 * 10/2021 Gatland ..... E04B 1/942
11,162,259 B2 11/2021 Pilz
11,230,839 B2 1/2022 Klein et al.
11,268,274 B2 3/2022 Pilz
11,299,884 B2 4/2022 Stahl, Jr. et al.
11,313,121 B2 4/2022 Quirijns et al.
11,401,711 B2 8/2022 Klein
11,421,417 B2 8/2022 Pilz et al.
11,466,449 B2 10/2022 Pilz et al.
11,486,150 B2 * 11/2022 Stahl ..... E04F 21/0053
11,512,464 B2 11/2022 Klein
11,560,712 B2 1/2023 Pilz et al.
11,674,304 B2 6/2023 Landreth et al.
11,697,937 B2 * 7/2023 Campbell ..... E04B 1/941 52/232
2002/0029535 A1 3/2002 Loper
2002/0095908 A1 7/2002 Kiser
2002/0160149 A1 10/2002 Garofalo
2002/0170249 A1 11/2002 Yulkowski

(56) References Cited

U.S. PATENT DOCUMENTS

2003/0079425 A1 5/2003 Morgan et al.
2003/0089062 A1 5/2003 Morgan et al.
2003/0196401 A1 10/2003 Surowiecki
2003/0213211 A1 11/2003 Morgan et al.
2004/0010998 A1 1/2004 Turco
2004/0016191 A1 1/2004 Whitty
2004/0045234 A1 3/2004 Morgan et al.
2004/0139684 A1 7/2004 Menendez
2004/0149390 A1 8/2004 Monden et al.
2004/0157012 A1 8/2004 Miller et al.
2004/0211150 A1 10/2004 Bobenhausen
2005/0031843 A1 2/2005 Robinson et al.
2005/0183361 A1 8/2005 Frezza
2005/0246973 A1 11/2005 Jensen
2006/0032163 A1 2/2006 Korn
2006/0096200 A1 5/2006 Daudet
2006/0123723 A1 6/2006 Weir et al.
2006/0137293 A1* 6/2006 Klein ..... E04B 2/7411 52/782.1
2006/0213138 A1 9/2006 Milani et al.
2006/0261223 A1 11/2006 Orndorff, II et al.
2006/0277841 A1* 12/2006 Majusiak ..... E04B 2/767 52/241
2007/0056245 A1 3/2007 Edmondson
2007/0068101 A1 3/2007 Weir et al.
2007/0125027 A1 6/2007 Klein
2007/0130873 A1 6/2007 Fisher
2007/0193202 A1 8/2007 Rice
2007/0261343 A1 11/2007 Stahl, Sr.
2008/0053013 A1 3/2008 Tollenaar
2008/0087366 A1 4/2008 Yu et al.
2008/0134589 A1 6/2008 Abrams et al.
2008/0172967 A1 7/2008 Hilburn
2008/0196337 A1 8/2008 Surowiecki
2008/0250738 A1 10/2008 Howchin
2009/0090074 A1 4/2009 Klein
2009/0094912 A1* 4/2009 Klein ..... E04B 2/7457 52/232
2009/0107064 A1 4/2009 Bowman
2009/0197060 A1 8/2009 Cho
2009/0223159 A1 9/2009 Colon
2009/0282760 A1 11/2009 Sampson et al.
2010/0199583 A1 8/2010 Behrens et al.
2010/0266781 A1 10/2010 Kusinski et al.
2011/0011019 A1 1/2011 Stahl, Jr. et al.
2011/0041415 A1 2/2011 Esposito
2011/0056163 A1 3/2011 Kure
2011/0067328 A1 3/2011 Naccarato et al.
2011/0099928 A1 5/2011 Klein et al.
2011/0113709 A1 5/2011 Pilz et al.
2011/0123801 A1 5/2011 Valenciano
2011/0146180 A1 6/2011 Klein
2011/0167742 A1 7/2011 Klein
2011/0185656 A1 8/2011 Klein
2011/0214371 A1 9/2011 Klein
2011/0247281 A1 10/2011 Pilz et al.
2011/0262720 A1 10/2011 Riebel et al.
2011/0274886 A1 11/2011 Flennert
2011/0302857 A1 12/2011 McClellan et al.
2012/0023846 A1 2/2012 Mattox et al.
2012/0180414 A1 7/2012 Burgess
2012/0247038 A1 10/2012 Black
2012/0266550 A1 10/2012 Naccarato et al.
2012/0297710 A1 11/2012 Klein
2013/0031856 A1 2/2013 Pilz et al.
2013/0118102 A1 5/2013 Pilz
2013/0118764 A1 5/2013 Porter
2013/0133844 A1 5/2013 Smart et al.
2013/0205694 A1 8/2013 Stahl, Jr.
2014/0219719 A1 8/2014 Hensley et al.
2014/0260017 A1 9/2014 Noble, III
2014/0345886 A1 11/2014 Yano et al.
2015/0086793 A1 3/2015 Kreysler et al.
2015/0135622 A1 5/2015 Muenzenberger et al.
2015/0135631 A1 5/2015 Förg
2015/0275506 A1 10/2015 Klein et al.
2015/0275507 A1 10/2015 Klein et al.
2015/0275510 A1 10/2015 Klein et al.
2015/0354210 A1 12/2015 Stahl, Jr. et al.
2015/0368898 A1 12/2015 Stahl, Jr. et al.
2016/0016381 A1 1/2016 Celis Marin
2016/0017598 A1 1/2016 Klein et al.
2016/0017599 A1 1/2016 Klein et al.
2016/0201893 A1 7/2016 Ksiezppolski
2016/0265219 A1 9/2016 Pilz
2016/0296775 A1 10/2016 Pilz et al.
2016/0348357 A1 12/2016 Smith et al.
2017/0016227 A1 1/2017 Klein
2017/0175386 A1 6/2017 Pilz
2017/0234004 A1 8/2017 Pilz
2017/0234010 A1 8/2017 Klein
2017/0260741 A1 9/2017 Ackerman et al.
2017/0306615 A1 10/2017 Klein et al.
2018/0010333 A1 1/2018 Förg
2018/0044913 A1 2/2018 Klein et al.
2018/0072922 A1 3/2018 Canale
2018/0171624 A1 6/2018 Klein et al.
2018/0171646 A1 6/2018 Stahl et al.
2018/0195282 A1 7/2018 Pilz
2018/0291619 A1 10/2018 Ackerman et al.
2019/0284799 A1 9/2019 Förg
2019/0323234 A1 10/2019 Watanabe et al.
2019/0323347 A1 10/2019 Hensley et al.
2020/0199867 A1* 6/2020 Ackerman ..... E04B 1/947
2020/0308829 A1 10/2020 Hunsaker
2020/0340239 A1 10/2020 Chang
2020/0340240 A1 10/2020 Pilz
2020/0362551 A1 11/2020 Klein et al.
2021/0010257 A1 1/2021 Klein et al.
2021/0017761 A1 1/2021 Klein et al.
2021/0040731 A1 2/2021 Pilz
2021/0062502 A1 3/2021 Archer et al.
2021/0101319 A1 4/2021 Klein et al.
2021/0164222 A1 6/2021 Pilz
2021/0189721 A1 6/2021 Klein et al.
2021/0285208 A1 9/2021 Pilz
2021/0396004 A1 12/2021 Pilz
2022/0010553 A1 1/2022 Pilz et al.
2022/0023684 A1 1/2022 Pilz et al.
2022/0042303 A1 2/2022 Pilz
2022/0056686 A1 2/2022 Pilz
2022/0098856 A1 3/2022 Pilz
2022/0106785 A1 4/2022 Klein
2022/0154456 A1 5/2022 Griffith et al.
2022/0162851 A1 5/2022 Pilz
2022/0268017 A1 8/2022 Pilz
2022/0349177 A1 11/2022 Pilz
2023/0114420 A1 4/2023 Pilz et al.
2023/0115315 A1 4/2023 Pilz et al.
2023/0203807 A1 6/2023 Pilz et al.
2023/0220665 A1 7/2023 Pilz et al.

FOREIGN PATENT DOCUMENTS

CA 2711659 2/2012
CA 2803439 3/2017
DE 2645807 B1 3/1978
DE 60213279 T2 7/2007
EP 0 335 347 10/1989
EP 0 346 126 12/1989
EP 0509701 A1 10/1992
EP 3 196 376 7/2017
EP 3 348 729 7/2018
EP 3348729 A1 * 7/2018 ..... B29C 48/12
EP 3 556 957 A1 10/2019
GB 2 159 051 11/1985
GB 2 239 213 A 6/1991
GB 2 411 212 8/2005
GB 2 424 658 10/2006
GB 2 494 721 A 3/2013
JP H06-042090 A 2/1994
JP H06-146433 5/1994
JP H06-220934 8/1994
JP H07-004620 U 1/1995

(56) References Cited

FOREIGN PATENT DOCUMENTS

| | | |
|---|---|---|
| KR | 100664665 B1 | 1/2007 |
| WO | WO 2003/038206 | 5/2003 |
| WO | WO 2004/071584 | 8/2004 |
| WO | WO 2007/103331 | 9/2007 |
| WO | WO 2013/113734 | 8/2013 |
| WO | WO 2017/129398 | 1/2017 |
| WO | WO 2019/108295 | 6/2019 |

OTHER PUBLICATIONS

U.S. Appl. No. 17/303,173, filed May 21, 2021, Pilz et al.
U.S. Appl. No. 17/453,158, filed Nov. 1, 2021, Pilz.
BlazeFrame 2009 catalog of products, available at least as of Mar. 4, 2010 from www.blazeframe.com, in 20 pages.
Catalog page from Stockton Products, printed from www.stocktonproducts.com, on Dec. 16, 2007, showing #5 Drip, in 1 page.
ClarkDietrich Building Systems, Product Submittal Sheet, (FTSC) Flat Trail Vertical Slide Clip. CD-FTSC11 Jul. 2011. 1 page.
Double TrackTM information sheets by Dietrich Metal Framing, in 2 pages; accessible on Internet Wayback Machine on Jul. 8, 2006.
FireStikTM by CEMCO Brochure, published on www.firestik.us, in 18 pages; accessible on Internet Wayback Machine on Aug. 13, 2007.
Information Disclosure Statement letter; U.S. Appl. No. 12/196,115, dated Aug. 4, 2011.
"Intumescent Expansion Joint Seals", Astroflame; http://www.astroflame.com/intumescent_expansion_joint_seals; Jul. 2011; 4 pages.
James A. Klein's Answer, Affirmative Defenses and Counterclaims to Third Amended Complaint; U.S. District Court, Central District of California; Case No. 2:12-cv-10791-DDP-MRWx; Filed Sep. 17, 2014; pp. 1-37.
Letter from Thomas E. Loop; counsel for defendant; Jun. 26, 2015.
Expert Report of James William Jones and exhibits; Case No. CV12-10791 DDP (MRWx); May 18, 2015.
Letter from Ann G. Schoen of Frost Brown Todd, LLC; Jun. 24, 2015.
"System No. HW-D-0607", May 6, 2010, Metacaulk, www.rectorseal.com, www.metacault.com; 2008 Underwriters Laboratories Inc.; 2 pages.
Trim-Tex, Inc., TRIM-TEX Wall Mounted Deflection Bead Installation Instructions, 2 pages. [Undated. Applicant requests that the Examiner review and consider the reference as prior art for the purpose of examination.].
"Wall Mounted Deflection Bead," Trim-Tex Drywall Products; Oct. 9, 2016; 3 pages.

* cited by examiner

TWO-PIECE DEFLECTION DRIFT ANGLE

INCORPORATION BY REFERENCE

Any and all applications for which a foreign or domestic priority claim is identified in the Application Data Sheet as filed with the present application are hereby incorporated by reference in their entirety.

BACKGROUND

Field

The disclosure generally relates to fire-rated building structures. In particular, the disclosure relates to fire-rated joint systems, wall assemblies, and other building structures that incorporate the fire-rated joint systems.

Description of Related Art

Fire-rated construction components and assemblies are commonly used in the construction industry. These components and assemblies are aimed at inhibiting or preventing fire, heat, or smoke from leaving one room or other portion of a building and entering another room or portion of a building. The fire, heat or smoke usually moves between rooms through vents, joints in walls, or other openings. The fire-rated components often incorporate fire-retardant materials which substantially block the path of the fire, heat or smoke for at least some period of time. Intumescent materials work well for this purpose, because they swell and char when exposed to flames helping to create a barrier to the fire, heat, and/or smoke.

One particular wall joint with a high potential for allowing fire, heat or smoke to pass from one room to another is the joint between the top of a wall and the ceiling, which can be referred to as a head-of-wall joint. In modern multi-story or multi-level buildings, the head-of-wall joint is often a dynamic joint in which relative movement between the ceiling and the wall is permitted. This relative movement is configured to accommodate deflection in the building due to loading of the ceiling or seismic forces. The conventional method for creating a fire-rated head-of-wall joint is to stuff a fire-resistant mineral wool material into the head-of-wall joint and then spray an elastomeric material over the joint to retain the mineral wool in place. This conventional construction of a fire-rated head-of-wall joint is time-consuming, expensive and has other disadvantages.

A wall assembly commonly used in the construction industry includes a header track, bottom track, a plurality of wall studs and a plurality of wall board members, possibly among other components. A typical header track resembles a generally U-shaped (or some other similarly shaped) elongated channel capable of receiving or covering the ends of wall studs and holding the wall studs in place. The header track also permits the wall assembly to be coupled to an upper horizontal support structure, such as a ceiling or floor of a higher level floor of a multi-level building.

Header tracks generally have a web and a pair of flanges, which extend in the same direction from opposing edges of the web. The header track can be a slotted header track, which includes a plurality of slots spaced along the length of the track and extending in a vertical direction. When the wall studs are placed into the slotted track, each of the plurality of slots aligned with a wall stud accommodates a fastener used to connect the wall stud to the slotted track. The slots allow the wall studs to move generally orthogonally relative to the track, creating a variable deflection gap between the wallboard and the upper horizontal support structure. In those areas of the world where earthquakes are common, movement of the wall studs is important. If the wall studs are rigidly attached to the slotted track and not allowed to move freely in at least one direction, the stability of the wall and the building might be compromised. With the plurality of slots, the wall studs are free to move. Even in locations in which earthquakes are not common, movement between the studs and the header track can be desirable to accommodate movement of the building structure due to other loads, such as stationary or moving overhead loads.

Recently, improvements to fire-rated head-of-wall joints have been developed. One example is the use a metal profile having a layer of intumescent material in a head-of-wall joint, such as the fire-rated angle manufactured and sold by the Applicant under the trade name Deflection Drift Angle (DDA™). The DDA™ angle is further described in U.S. Pat. No. 8,595,999, the entirety of which is hereby incorporated by reference. The DDA™ angle can be installed along with the installation of the header track or can be installed after the installation of the header track. Such an arrangement avoids the need to have the framers return after the installation of the wall board to install fire sealant in the deflection gap between the edge of the wall board and the overhead structure. When temperatures rise (e.g., due to a fire), the intumescent material on the DDA™ fire block product expands. This expansion creates a barrier which fills the deflection gap and inhibits or at least substantially prevents fire, heat and smoke from moving through the head-of-wall joint and entering an adjacent room for at least some period of time.

SUMMARY

Although the DDA™ fire block represents an improvement over the conventional method of stuffing mineral wool material into the head-of-wall joint and applying the elastomeric spray material over the mineral wool, there still exists room for improved or alternative products, materials and methods for efficiently and cost-effectively creating fire-rated wall joints. The systems, methods and devices described herein have innovative aspects, no single one of which is indispensable or solely responsible for their desirable attributes. Without limiting the scope of the claims, some of the advantageous features will now be summarized.

According to one aspect, a fire-rated component for sealing a head-of-wall gap, the component includes a fire-rated angle of a first material including an upper flange and a lower flange. The upper flange connects with the lower flange at a corner. A gasket profile of a second material includes an upper flange and a lower flange, the lower flange connected with the upper flange at a corner. A fire-blocking strip connects with the lower flange. The fire-rated angle is coupled with the gasket profile.

According to another aspect, the lower flange of the gasket profile includes a slot. A lower end of the lower flange of the fire-rated angle disposed within the slot couples the fire-rated angle with the gasket profile.

According to another aspect, the upper flange of the fire-rated angle includes a planar section.

According to another aspect, the lower flange of the fire-rated angle includes a planar section.

According to another aspect, the upper flange of the fire-rated angle is perpendicular with the lower flange of the fire-rated angle.

According to another aspect, the first material of the fire-rated angle is steel and the second material of the gasket profile is vinyl.

According to another aspect, the lower flange of the fire-rated angle includes a second fire-blocking strip.

According to another aspect, the upper flanges are generally aligned and the lower flanges are generally aligned.

According to another aspect, the upper flange of the gasket profile has a flare-out configured to seal against an overhead structure.

According to another aspect, the lower flange of the gasket profile includes an upper section and a lower section, the upper section offset from the lower section by a transition section.

According to another aspect, the upper section is aligned parallel with the lower section.

According to another aspect, an outer surface of the fire-blocking strip is aligned with the lower section of the lower flange of the gasket profile.

According to another aspect, the second material is a polymer.

According to another aspect, a fire-rated component for sealing a head-of-wall gap includes a fire-rated insert of a first material. A gasket profile or a second material includes an upper flange, a lower flange; and a fire-blocking strip coupled on an interior side of the lower flange. The fire-rated insert is coupled with an interior side of the gasket profile.

According to another aspect, the first material of the fire-rated insert comprises steel and the second material of the gasket profile comprises vinyl.

According to another aspect, an upper end of the fire-rated insert includes a second fire-blocking strip.

According to another aspect, the lower flange of the gasket profile includes an upper section and a lower section, the upper section offset from the lower section by a transition section.

According to another aspect, the upper section is aligned parallel with the lower section.

According to another aspect, the lower flange includes an inner flange, the inner flange enclosing a portion of the interior side to form a slot, a lower end of the fire-rated insert received within the slot.

According to another aspect, the fire-rated insert contacts the fire-blocking strip.

According to another aspect, a wall assembly includes a header track configured to be coupled to a surface of an overhead structure, the header track having a web and first and second flanges extending from the web in the same direction, wherein each of the first and second flanges is substantially planar such that the track defines a substantially U-shaped cross section. At least one stud couples to the header track, an upper end of the stud located between the first and second flanges. At least one wallboard couples to the stud, an upper end of the wallboard overlapping the first flange of the header track. A deflection gap is formed between the upper end of the wallboard and the surface of the overhead structure. The deflection gap is variable between a closed position and an open position. The upper flanges of the fire-rated angle and the gasket profile are positioned between the web and the overhead structure and the lower flanges of the fire-rated angle and the gasket profile are positioned at least partially within the deflection gap.

BRIEF DESCRIPTION OF THE DRAWINGS

Various embodiments are depicted in the accompanying drawings for illustrative purposes, and should in no way be interpreted as limiting the scope of the embodiments. Various features of different disclosed embodiments can be combined to form additional embodiments, which are part of this disclosure.

DETAILED DESCRIPTION

The various features and advantages of the systems, devices, and methods of the technology described herein will become more fully apparent from the following description of the embodiments illustrated in the figures. These embodiments are intended to illustrate the principles of this disclosure, and this disclosure should not be limited to merely the illustrated examples. The features of the illustrated embodiments can be modified, combined, removed, and/or substituted as will be apparent to those of ordinary skill in the art upon consideration of the principles disclosed herein.

The following disclosure provides an elongate, fire-rated joint component or fire-blocking assembly, which is configured to provide fire protection and pass the relevant UL fire rating tests, or other relevant fire rating tests or standards. The fire-rated assembly may be installed in a deflection gap of a wall assembly that allows dynamic movement according to the requirements of UL-2079.

In one embodiment, the two piece fire-rated assembly can include one piece made of steel and one piece made of vinyl. One reason for this is that steel, generally, will not melt in a fire and will provide a continuous level of fire protection to the deflection joint. However, the steel profile by itself may not provide enough fire protection to pass a UL-2079 5th edition fire test and/or it may not provide adequate sound protection to the deflection gap. The second piece made from vinyl. The vinyl profile slides over the steel profile and locks them together so that the two can be assembled and installed as one piece.

The vinyl profile functions to provide sound protection. Unlike steel, the vinyl profile is very flexible and when the vinyl profile meets the overhead structure it can compress and seal off against uneven overhead structures to improve sound protection.

During a fire, a portion of the vinyl profile can flap downward and expose the intumescent material to the fire and heat which may cause the intumescent to expand upward and seal off the deflection gap. This whole process can take up to 20 minutes before the deflection is sealed off. During this time the steel profile will remain in place over the leg of the header track and continue to offer a level of fire protection. Without the steel profile, the fire and heat would be able to pass through the deflection gap while the intumescent tape of vinyl profile was still expanding.

Figure 1:
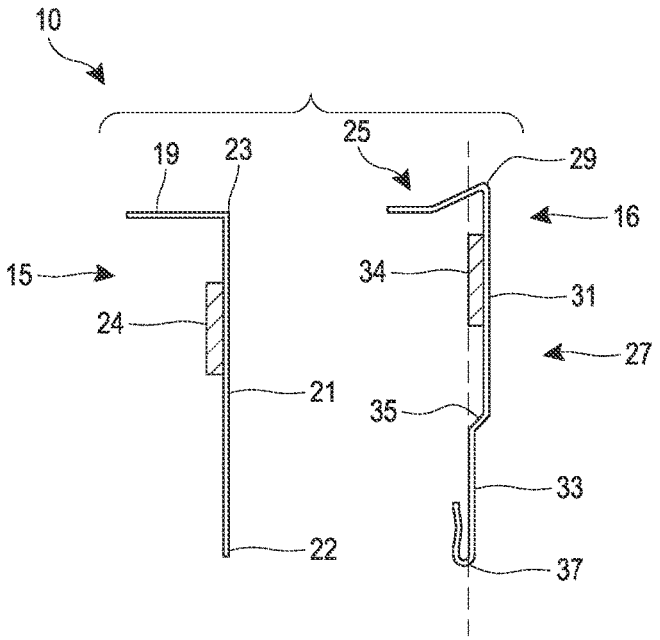
FIG. 1 is an exploded view of a fire blocking assembly, including a fire-rated angle and a gasket profile.

FIG. 1 illustrates an exploded view of the fire-rated profile assembly 10. The fire-rated profile assembly 10 is shown in cross-section. The fire-rated profile assembly 10 can be an elongate strip or gasket that can extend along the upper edge of a wall in a head-of-wall assembly as shown in cross-section in FIG. 3. The fire-rated profile assembly 10 can include a fire-rated angle 15 and a gasket profile 16. The fire-rated angle 15 and the gasket profile 16 can be formed in various lengths (e.g., 5 foot, 10 foot, 12 foot, or other), each preferably having the same cross-section and shape throughout. Assembled together, the fire-rated angle 15 and the gasket profile 16 can form the fire-rated profile assembly 10. The fire-rated profile assembly 10 can be installed across a head-of-wall assembly 100 to prevent the passage of smoke, heat, noise and/or other gases from passing through the head-of-wall assembly from one side of the wall to the other.

The fire-rated angle 15 can include an upper flange 19. The upper flange 19 can include one or more planar, curvilinear and/or stepped regions. The upper flange 19 can connect with a lower flange 21 at a corner 23. The lower flange 21 can include one or more planar, curvilinear and/or stepped regions. In the implementation shown in FIG. 1, the upper flange 19 is planar throughout and the lower flange 21 is planar throughout. The upper flange 19 can be perpendicular with the lower flange 21. Alternatively, the upper and lower flanges 19, 21 can be at an angle other than perpendicular. The lower flange 21 can extend from the corner 23 to a lower end 22. Optionally, the lower end 22 can comprise a plurality of through holes or apertures extending therethrough for assembly within the head-of-wall assembly.

The lower flange 21 can include a fire blocking strip 24. The fire blocking strip 24 can include an intumescent material that expands upon being heated. The fire blocking strip 24 can be attached by an adhesive with the lower flange 21. The fire blocking strip 24 can be attached on an interior side of the lower flange 27 (e.g., on the side of the upper flange 19 relative to the corner 23). The fire blocking strip 24 can be located adjacent to and/or in contact with the upper flange 19. The fire blocking strip 24 can extend along the interior surface of the lower flange 21 between the corner 23 and the lower end 22. Optionally, the fire blocking strip 24 can extend all the way from the corner 23 or the upper flange 19 to the lower end 22.

The fire-rated angle 15 can comprise a steel or other metal material. The steel can be generally resistant to deformation when exposed to heat or fire for at least a limited amount of time. The steel material can facilitate the fire-rated profile assembly 10 retaining its shape at least partially or temporarily when exposed to heat or fire.

The gasket profile 16 can include an upper flange 25. The upper flange 25 can include one or more planar, curvilinear and/or stepped regions. The upper flange 25 can include a flare out for forming a corner 29. The corner 29 can be form a compressible seal. The gasket profile 16 can include a lower flange 27. The lower flange 27 can include one or more planar, curvilinear and/or stepped regions. The lower flange 27 can connect with the upper flange 25 at the corner 29. The lower flange 27 can extend from the corner 29 to a hem or hook portion 37.

The lower flange 27 can include an upper section 31. The upper section 31 can be planar. The lower flange 27 can include a lower section 33. The lower section 33 can be an offset leg. The lower section 33 can be planar. The lower section 33 can attach with the upper section 31 through a transition section 35. The transition section 35 can offset the planar portions of the upper section 31 from the lower section 33. The direction of offset of the transition 35 can be in the same direction of the upper flange 25 extending from the corner 29. The offset of the transition can be the same width as a common framing screw. This will this will help maintain a tight seal when a drywall or wallboard is installed over the lower section 33. It will also allow the fire rated assembly 10 to be pre-attached to a header track, as described further below.

The lower section 33 can include the hook portion 37. The hook portion 37 can include a portion of the lower flange 27 that is bent backwards on itself to extend generally upwardly. The hook portion 37 can form a slot. The slot can be sized to receive the lower end 22 of the fire-rated angle 15.

The lower flange 27 can include a fire blocking strip 34. The fire blocking strip 34 can be adhesively attached with the lower flange 27. The fire blocking strip 34 can be attached on an interior side of the lower flange 27. The fire blocking strip 34 can be attached with the upper section 31. The fire blocking strip 34 can be adjacent to the corner 29 and/or the upper flange 25. The fire blocking strip 34 can extend from the corner 29 towards the transition 35. An outer surface of the fire blocking strip 34 can be aligned with the lower section 33, as shown by the dotted line in FIG. 1. The transition section 35 can be sized to offset the lower section 33 from the upper section 31 by the thickness of the fire blocking strip 34.

The gasket profile 16 can be formed of a vinyl or other polymer material. The material of the gasket profile 16 can be sensitive to heat such that it deforms when heated at temperatures associated with fires.

Figure 2:
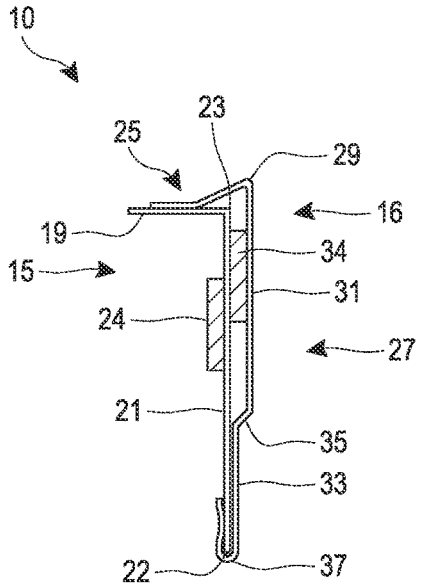
FIG. 2 shows an assembled view of the fire-rated assembly.

FIG. 2 shows the fire-rated angle 15 assembled with the gasket profile 16 to form the fire-rated profile assembly 10. The lower end 22 can be assembled within the slot of the hook portion 37. The lower flange 21 can be assembled against the lower section 33 and/or the fire blocking strip 34. The upper flange 19 can be assembled in contact with the upper flange 25. The corner 23 can be offset from the corner 29 by the flare out of the upper flange 25. The fire blocking strip 24 can be aligned with or partially offset with the fire blocking strip 34. A length of the lower flange 21 can be sized such that the upper flange 19 contacts the upper flange 25 with the lower end 22 assembled within the slot of the hook portion 37.

Figure 3:
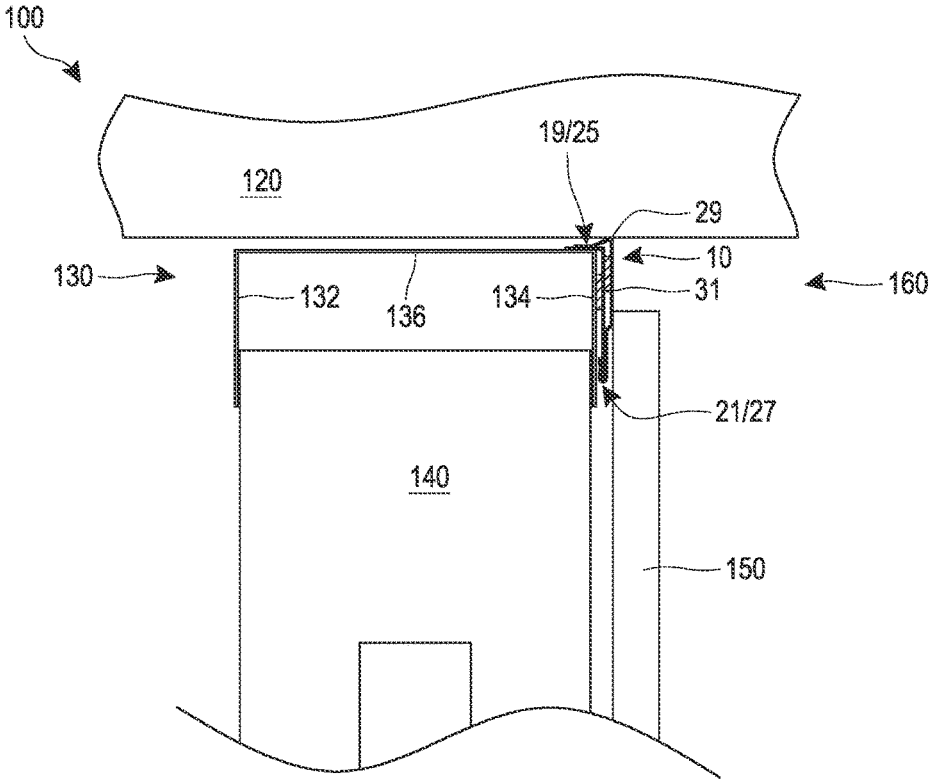
FIG. 3 shows the fire-rated assembly installed within a deflection gap in a head-of-wall assembly.

FIG. 3 shows the fire-rated profile assembly 10 installed within a head-of-wall assembly 100. The head-of-wall assembly can include a ceiling or overhead structure 120. A header track 130 can be attached with the overhead structure 120. The header track 130 can include a web 136, a first flange 132 extending from the web 136 and a second flange 134 extending from the web 136. The first flange 132 and the second flange 134 can extend generally perpendicular to and on opposite sides of the web 136. A stud 140 can be received between the first flange 132 and the second flange 134. A wall board 150 can be attached with the stud 140. The upper end of the wall board 150 can form a deflection gap between the overhead structure and the wall board 150. The deflection gap 160 can be variable as the stud 140 and the wall board 150 move relative to the overhead structure 120.

The fire-rated profile assembly 10 can be assembled within the deflection gap 160. The upper flanges 19, 25 can be installed between the web 136 and the overhead structure 120. The lower flanges 21, 27 can be installed along the length of the second flange 134. The lower flanges 21, 27 can be installed between the second flange 134 and the wall board 150. The fire blocking strip 24 can be in contact with the second flange 134. The upper section 31 can be in slidable contact with an inner face of the wall board 150, as the wall board 150 cycles between open and closed configurations of the head-of-wall assembly 100. The corner 29 can be compressed against the overhead structure 120 to form a seal therewith.

Figure 4:
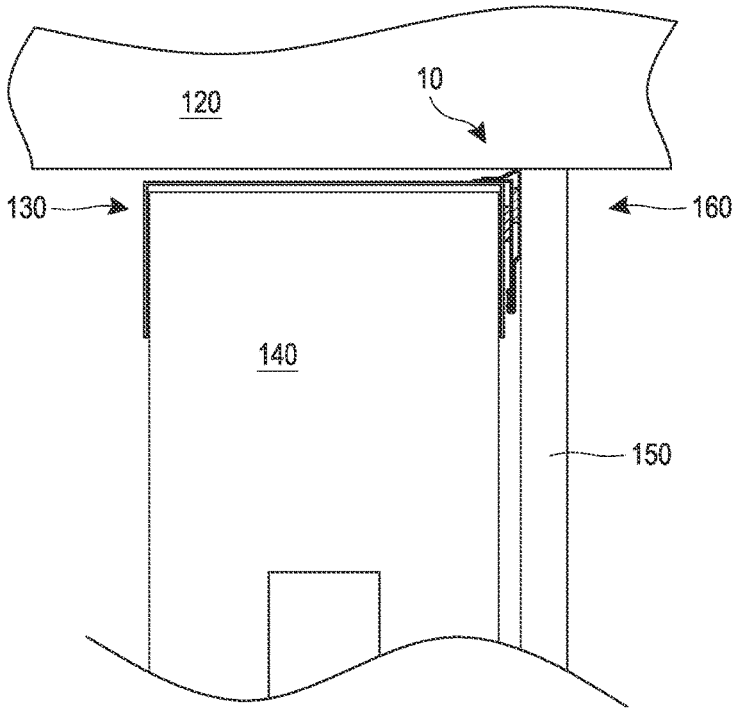
FIG. 4 shows the head-of-wall assembly in a closed configuration.

The fire-rated profile assembly 10 can be maintained within the deflection gap 160 through mechanical engagement between the overhead structure 120 and the web 136. The wall board 150 installed over the lower flanges 21, 27 can also maintain the position of the fire-rated profile assembly 10 within the deflection gap 160. Advantageously, this arrangement can be faster and easier to install than using mechanical fasteners or traditional stuff-and-spray techniques. FIG. 4 shows the head-of-wall assembly 100 with the deflection gap 160 in a closed configuration with the wall board 150 slid over the lower flange 27.

Figure 5:
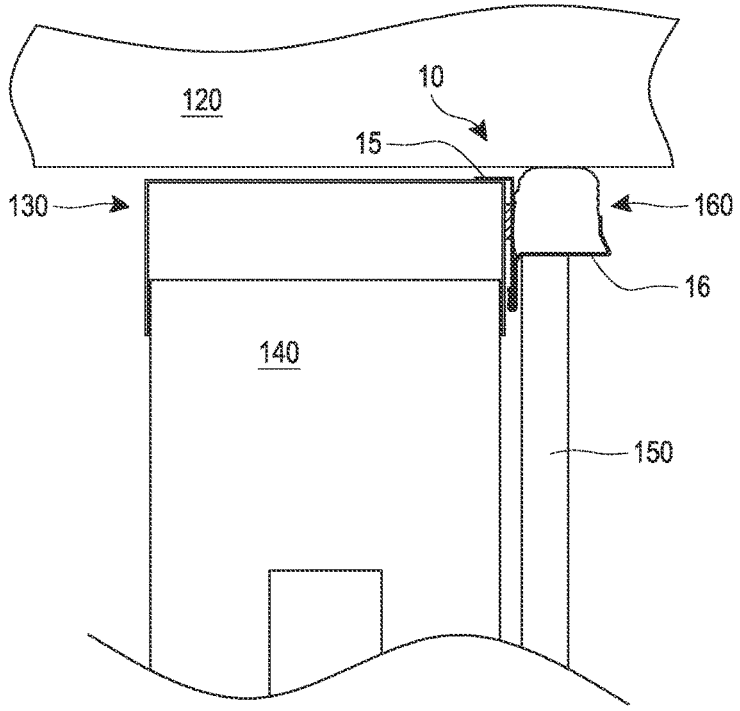
FIG. 5 shows the head-of-wall assembly with the fire blocking assembly in an expanded configuration after being exposed to heat or fire.

FIG. 5 shows the results of fire or heat on the head-of-wall assembly 100 with the fire-rated profile assembly 10 installed within the deflection gap 160. The heat can cause the material of the gasket profile 16 to soften and fold outwardly across the top portion of the wall board 150. Once the portion of the gasket profile bends down the fire-blocking strip 34 faces the overhead structure 120. This can be ideal for expansion of the intumescent because it will expand upward against the overhead structure 120 and seal off the deflection gap 160. The fire-rated angle 15 can remain in place to offer some fire protection while the intumescent is expanding. The fire-rated angle 15 can remain in place being formed of a metal or steel material. The fire blocking strip 34 can expand upwardly towards the overhead structure 120. The upper flange 25 can at least partially contain the expanding intumescent material of the fire blocking strip 34. This can prevent the fire blocking strip 4 from falling out of the deflection gap 160 prematurely. The fire blocking strip 24 can also expand to provide additional blockage across the deflection gap 160.

Figure 6:
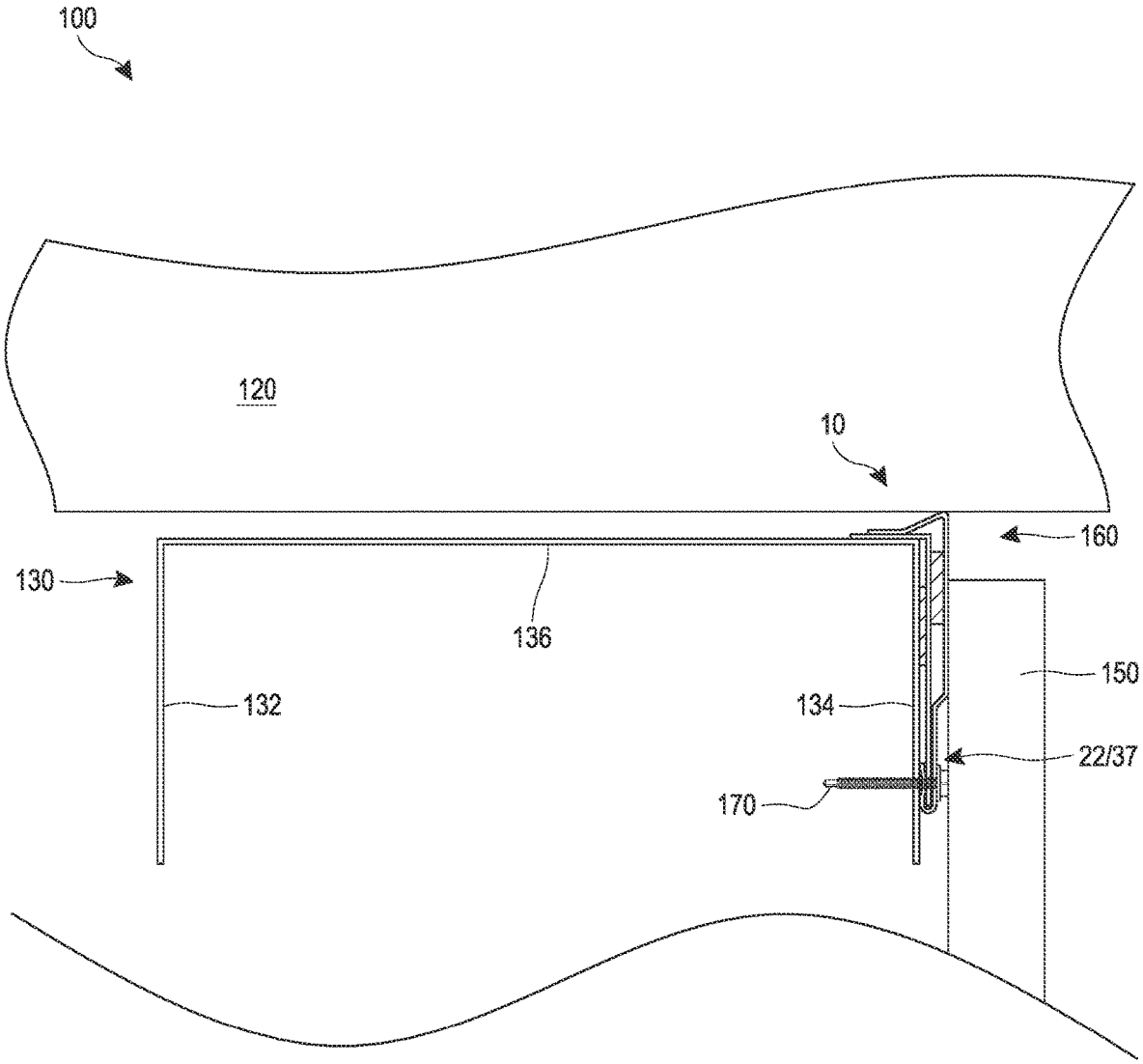
FIG. 6 shows the fire-rated assembly preinstalled on a header track of the head-of-wall assembly.

FIG. 6 shows the fire-rated profile assembly 10 preinstalled on the header track 130. A fastener 170 can be installed through the lower portion 33 of the gasket profile 16. The fastener 170 can be inserted through a hole formed in the lower end 22 of the fire-rated angle 15 and/or the lower flange 27 of the gasket profile 16. The fastener 170 can be installed through the second flange 134 of the header track 130. The fastener 170 can be offset from any of the studs of the head-of-wall assembly 100 (e.g., into and out of the page as shown in FIG. 6).

Advantageously, the fire-rated profile assembly 10 can be pre-installed on the header track 130. The header track 130 can then be assembled against the overhead structure 120 such as through additional mechanical fasteners through the web 136. The pre-installation can dramatically reduce the amount of time required for attaching the fire-rated profile assembly 10 within the head-of-wall assembly 100. It can be much easier to pre-install the fire-rated profile assembly 10 than inserting the upper flanges 19, 25 between the overhead structure 120 and the web 136. The transition section 135 can be sized to accommodate the head of the fastener 170 so that the wall board 150 can be engaged with the upper section 131 and/or the head of the fastener 170.

Figure 7:
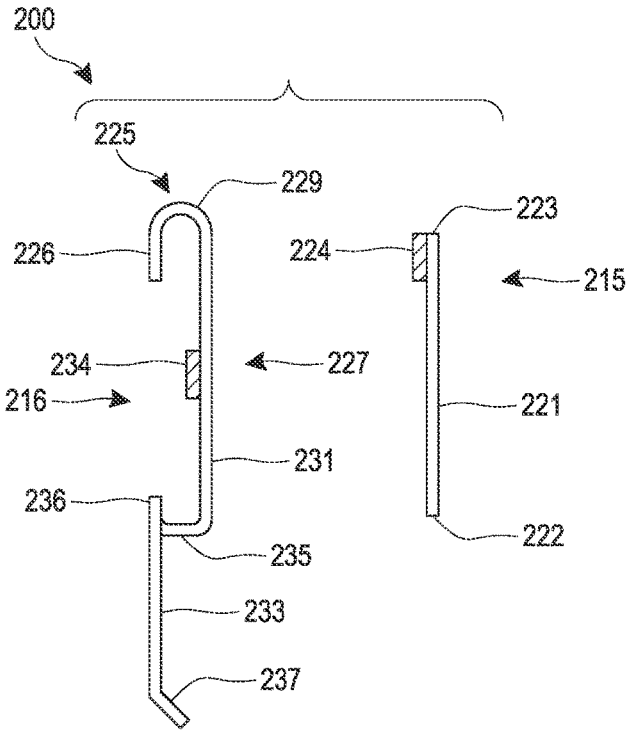
FIG. 7 shows another embodiment of a fire-rated assembly including gasket profile and a fire-rated insert.

FIG. 7 shows another embodiment of a fire-rated assembly 200. The fire-rated assembly 200 can be a two-piece fire-rated assembly including a vinyl or other polymer member and a steel or other metallic member. The fire-rated assembly 200 can include a gasket profile 216. The gasket profile 216 can include an upper flange 225. The upper flange 225 can include one or more planar, curvilinear or stepped sections. The upper flange 225 can include a downward extending flange 226. The downward extending flange 226 can include a flat region that is generally vertical.

The upper flange 225 can include or be coupled with a corner 229. The corner 229 can be a curved or bent section of the material of the gasket profile 216. A lower flange 227 can extend from the corner 229. The lower flange 227 can include an upper section 231 and a lower section 233. The upper section 231 can include straight, curvilinear or stepped regions. The upper section 231 can be coupled with the lower section 233 by a transition section 235. The transition section 235 can be orthogonal to the flat portion or straight portion of the upper section 231. The lower section 233 can include straight, curvilinear or stepped regions. The lower section 233 can couple on an upper end with the transition section 235. The lower section 233 and/or the upper section 231 can include a planar section that is perpendicular to the transition section 235.

The lower section 233 can include a kick out 237. The kick out 237 can comprise a planar section that is at an angle with respect to a planar section of the lower section 233. The kick out 237 can be angled towards an exterior side of the gasket profile 216 (e.g., opposite the extension of the upper flange 225).

The transition section 235 can include an inner flange 236. The inner flange 236 can extend from an upper end of the lower section 233. The inner flange 236 can at least partially form an interior region of the gasket profile 216 between the upper section 231 and the inner flange 236. The upper section 231 can include a fire blocking strip 234. The fire blocking strip 234 can be located between the corner 229 and the transition section 235 along the upper section 231. The fire blocking strip 234 can be located within the interior section of the gasket profile 216.

The fire-rated assembly 200 can further include a fire-rated insert 215. The fire-rated insert 215 can comprise a steel plate. The steel plate can include planar, straight, curvilinear or stepped regions. The insert 215 can include a straight section 221. The straight section 221 can extend between an upper end 223 and a lower end 222. The upper end 223 can include a fire blocking strip 224. The fire blocking strip 224 can extend between the upper end 223 and the lower end 222.

Figure 8:
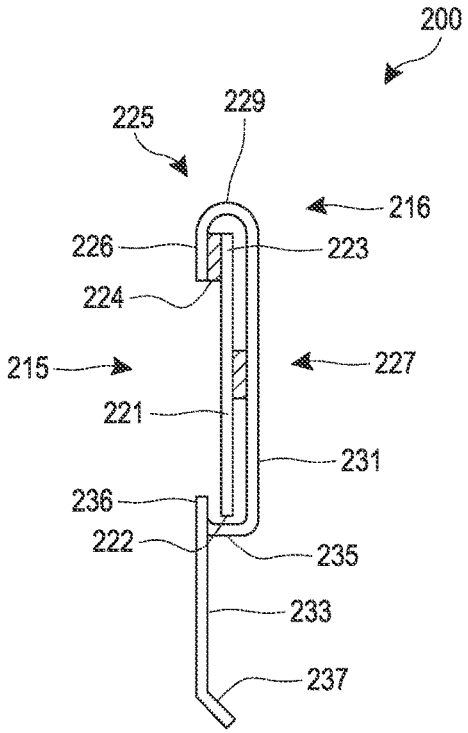
FIG. 8 shows the fire-rated assembly in an assembled configuration.

As shown in FIG. 8, in an assembled configuration the fire-rated insert 215 can be installed within the interior section of the gasket profile 216 (e.g., formed by the inner flange 236, the upper flange 225, and/or the upper section 231). The upper end 223 can be installed within a slot formed by the downwardly extending flange 226. The lower end 222 can be installed within a slot formed by the inner flange 236. The fire-rated insert 215 can be installed within the interior of the gasket profile 216 by elastically deforming the material of the gasket profile 216 (or sliding at one end of the gasket profile 216). In the assembled configuration, the straight section 221 can contact the fire blocking strip 234. The fire blocking strip 224 can contact the downwardly extending flange 226 and/or the corner 229.

A head-of-wall assembly 300 can include an overhead structure 320, a header track 330 attached with the overhead surface 320. The header track 330 can include a first flange 332, a second flange 334, and a web 336. A stud 340 can be assembled between the first flange 332 and the second flange 334 and coupled therewith by a first mechanical fastener 374. A wall board 350 can be attached with the stud 340. A deflection gap 360 can be formed between the upper end of the wall board 350 and the overhead structure 320. The stud 340 and the wallboard 350 can be movable vertically to open and close the deflection gap 360.

The fire-rated assembly 200 can be installed alongside of the second flange 334 within the deflection gap 360. A second mechanical fastener 372 can be installed through the lower section 233 of the lower flange 227. The second fastener 372 can attach the assembly 200 with the second flange 334. In certain implementations, the fire-rated assembly 200 can be preinstalled on the header track 330. The corner 229 can be compressed against the overhead structure 320 to form a seal therewith. The interior side of the fire-rated assembly 200 can face the second flange 334. The downwardly extending flange 226, the lower section 233, and/or the inner flange 236 can be flush against the second flange 334. The insert 215 can be located within the interior portion of the gasket profile 216 facing the second flange 334.

Figure 9A:
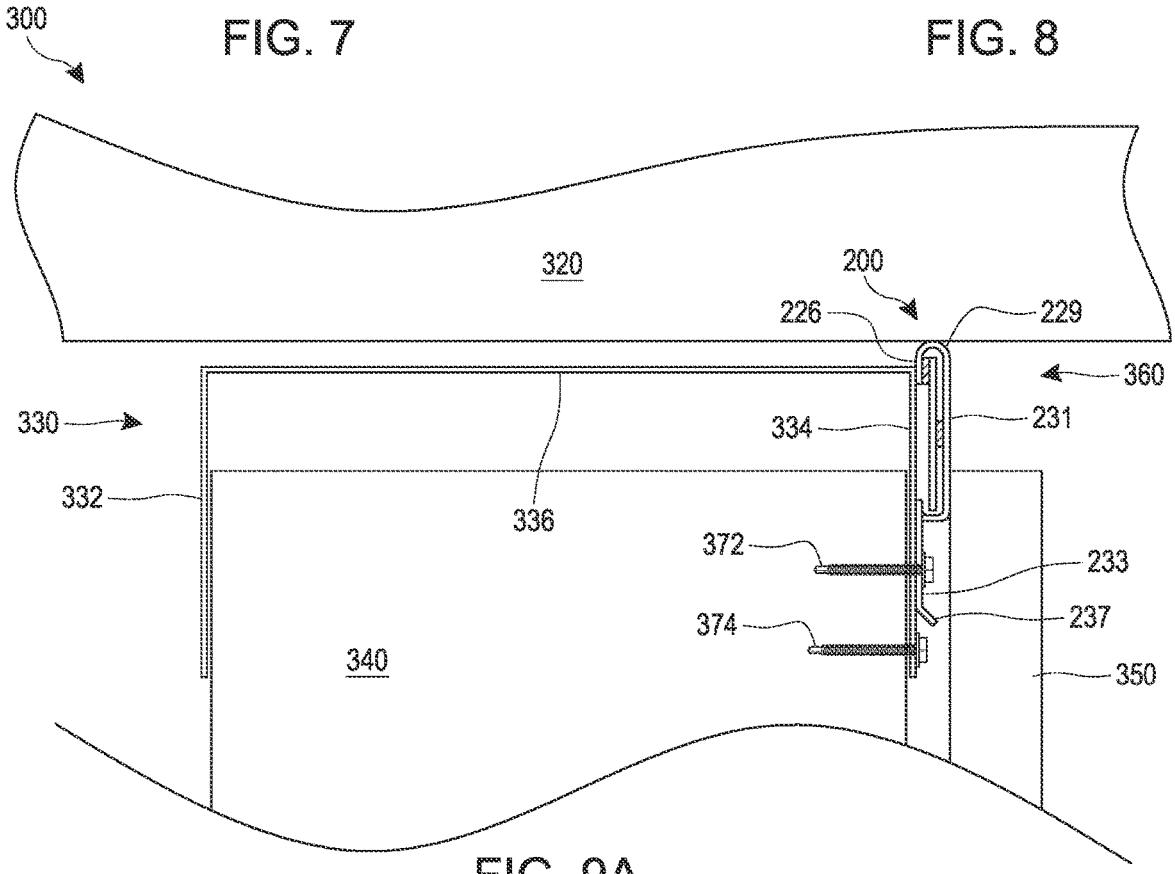
FIG. 9A shows a head-of-wall assembly with the fire-rated assembly installed within a deflection gap.
Figure 9B:
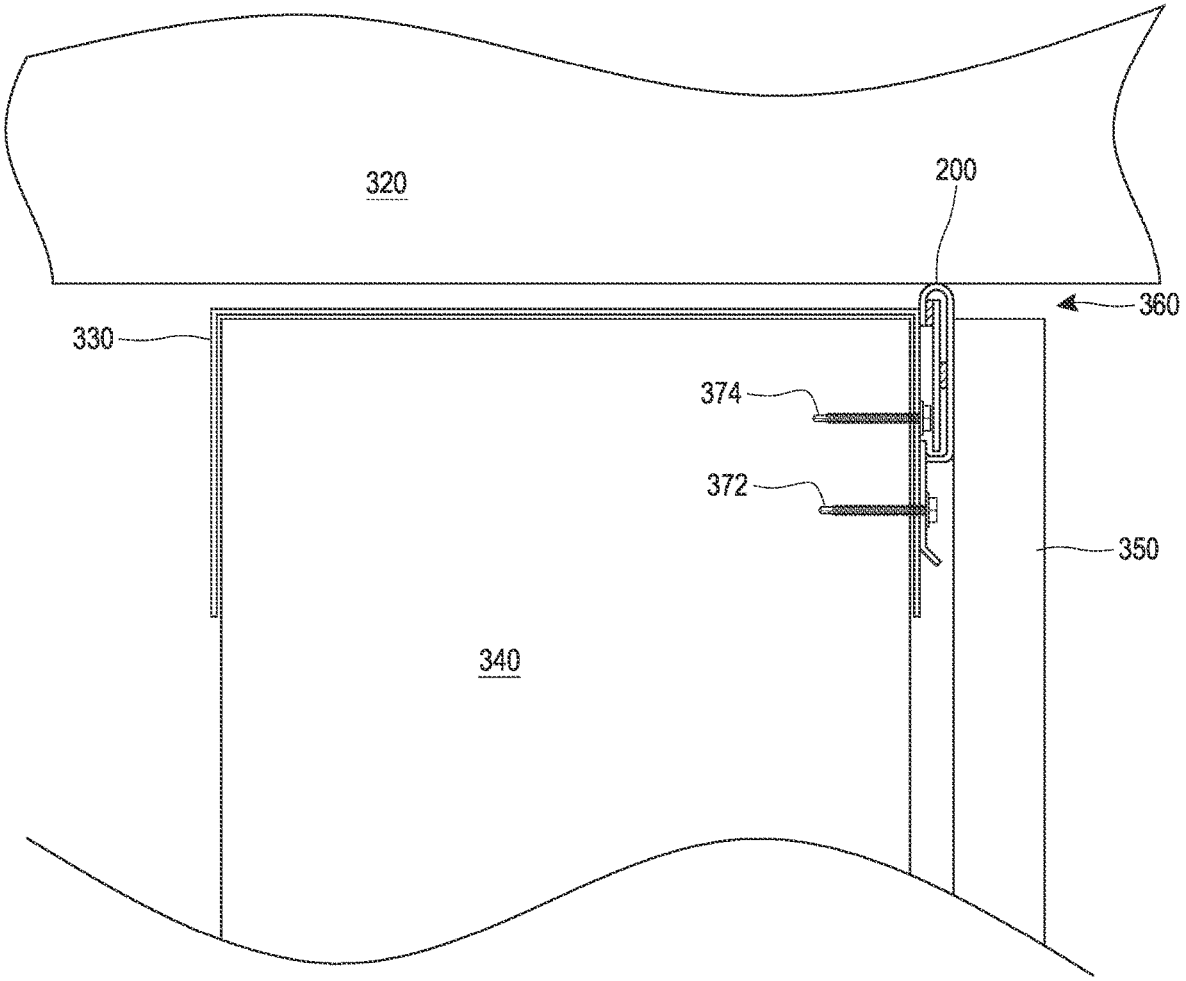
FIG. 9B shows the head-of-wall assembly in a closed configuration.
Figure 9C:
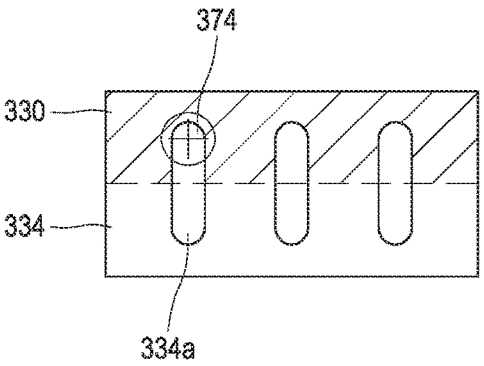
FIG. 9C shows the position of a fastener in the closed configuration.
Figure 9D:
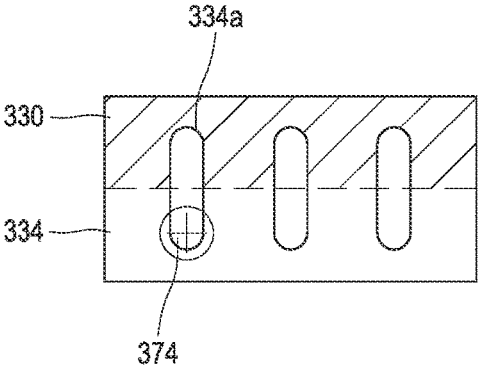
FIG. 9D shows the position of the fastener in an open configuration of the head-of-wall assembly.

The first fastener 374 can be offset from the second fastener 372 (e.g., into and out of the page as shown in FIG. 9A). In other words, the fire-rated assembly 200 can be attached at locations along the header track 330 that are not in axial alignment (into and out of the page) with the second fastener 372 or the stud 340. The first fastener 374 can be movable within a slot 334*a*, as shown in FIG. 9C (closed configuration) and 9D (open configuration), as the deflection gap 360 cycles between open and closed configurations. Accordingly, as the deflection gap moves between the open and closed configurations, the head of the first fastener 374 can move underneath the lower section 233 of the lower flange 227. The flexible material of the gasket profile 216 can allow passage of the first fastener 374. The vinyl material is flexible so that, even though the gasket profile is attached to the second flange 334 of the track 330 with the second fastener 372 (e.g. framing screw) the first fastener 374 (e.g., framing screw) that attaches the stud 340 to the track 330 will still be able to cycle under the gasket profile flange 227, as shown. This sliding can be facilitate by the kick out 237. Optionally, the inner flange 236 can include a kick out, like the kick out 237.

When the fire-rated assembly 200 is exposed to heat or fire, the fire blocking strips 224 and/or 234 can expand to fill the deflection gap 360, the formable material of the gasket profile 216 can be at least partially maintained in its position by the insert 215. The insert 215 along with the upper section 231 and the upper flange 225 can fold outwardly across the top of the wall board 350 when exposed to heat or fire. The insert 215 can maintain structural integrity of the upper section 231 and thereby direct the expansion of the fire blocking strips 224, 234 towards the overhead structure 320 to close the deflection gap 360.

Certain Terminology

Terms of orientation used herein, such as "top," "bottom," "proximal," "distal," "longitudinal," "lateral," and "end," are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees. Ranges given are inclusive of endpoints.

Summary

Several illustrative embodiments of head-of-wall assemblies and components such as sound-blocking and/or fire-blocking gasket profiles have been disclosed. Although this disclosure has been described in terms of certain illustrative embodiments and uses, other embodiments and other uses, including embodiments and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various embodiments. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one embodiment or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative embodiments have been described, any embodiments having equivalent elements, modifications, omissions, and/or combinations are also within the scope of this disclosure. Moreover, although certain aspects, advantages, and novel features are described herein, not necessarily all such advantages may be achieved in accordance with any particular embodiment. For example, some embodiments within the scope of this disclosure achieve one advantage, or a group of advantages, as taught herein without necessarily achieving other advantages taught or suggested herein. Further, some embodiments may achieve different advantages than those taught or suggested herein.

Some embodiments have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular embodiment of the inventions disclosed herein. No aspects of this disclosure are essential or indispensable. In many embodiments, the devices, systems, and methods may be configured differently than illustrated in the figures or description herein. For example, various functionalities provided by the illustrated modules can be combined, rearranged, added, or deleted. In some embodiments, additional or different processors or modules may perform some or all of the functionalities described with reference to the example embodiment described and illustrated in the figures. Many implementation variations are possible. Any of the features, structures, steps, or processes disclosed in this specification can be included in any embodiment.

In summary, various embodiments and examples of head-of-wall assemblies and fire blocking tracks and related methods have been disclosed. This disclosure extends beyond the specifically disclosed embodiments and examples to other alternative embodiments and/or other uses of the embodiments, as well as to certain modifications and equivalents thereof. Moreover, this disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims.

What is claimed is:

1. A fire-rated component for sealing a perimeter building joint, the component comprising:

a planar insert piece of a first material comprising an upper free end and a lower free end; and a gasket profile of a second material comprising:

an upper portion;

a lower portion;

a middle portion connecting the upper portion and the lower portion;

at least one fire-blocking material coupled to the middle portion;

wherein the planar insert piece is secured within the gasket profile such that the upper free end of the insert piece is disposed within a cavity space in the upper portion and the lower free end of the insert piece is disposed within a cavity space in the lower portion.

2. The fire-rated component of claim 1, wherein the first material of the insert piece comprises steel and the second material of the gasket profile comprises vinyl.

3. The fire-rated component of claim 1, wherein the insert piece further comprises a fire blocking material.

4. The fire-rated component of claim 1, wherein the fire-blocking material is an intumescent tape.

5. The fire-rated component of claim 1, wherein the upper portion comprises a round top.

6. The fire-rated component of claim 1, wherein the insert piece is aligned parallel with the middle portion in use.

7. The fire-rated component of claim 6, wherein the insert piece contacts the fire-blocking material of the gasket profile in use.

8. The fire-rated component of claim 7, wherein the insert piece is a flat member.

9. A wall assembly comprising:

a header track configured to be coupled to a surface of an adjacent structure, the header track having a web, a first flange and a second flange;

at least one stud coupled to the header track, an upper end of the stud located between the first and second flanges;

at least one wallboard coupled to the stud, an upper end of the wallboard overlapping the first flange of the header track;

a deflection gap formed between the upper end of the wallboard and the surface of the adjacent structure, the deflection gap being variable between a closed position and an open position; and the fire-rated component of claim 1, wherein the lower portion of the gasket profile is positioned between a bottom section of the first flange of the header track and the upper end of the wallboard.

10. The wall assembly of claim 9, wherein the lower portion is coupled to the header track with a mechanical fastener.

11. The wall assembly of claim 9, wherein the lower portion contacts the header track in use.

* * * * *